US010881889B2

(12) United States Patent
Lilley

(10) Patent No.: US 10,881,889 B2
(45) Date of Patent: Jan. 5, 2021

(54) GAIT PATTERN TRAINING DEVICE

(71) Applicant: AccesSportAmerica, Inc., Acton, MA (US)

(72) Inventor: Ross W. Lilley, Acton, MA (US)

(73) Assignee: AccesSportAmerica, Inc., Acton, MA (US)

( * ) Notice: Subject to any disclaimer, the term of this patent is extended or adjusted under 35 U.S.C. 154(b) by 0 days.

(21) Appl. No.: 16/567,662

(22) Filed: Sep. 11, 2019

(65) Prior Publication Data

US 2020/0069989 A1 Mar. 5, 2020

Related U.S. Application Data

(62) Division of application No. 15/472,767, filed on Mar. 29, 2017, now Pat. No. 10,449,403.

(Continued)

(51) Int. Cl.

| | |
|---|---|
| ***A63B 21/00*** | (2006.01) |
| ***A63B 21/22*** | (2006.01) |
| ***A63B 22/02*** | (2006.01) |
| ***A63B 22/06*** | (2006.01) |
| ***A63B 21/28*** | (2006.01) |
| ***A61H 3/00*** | (2006.01) |
| ***A61H 1/02*** | (2006.01) |

(Continued)

(52) U.S. Cl.

CPC ..... *A63B 21/00181* (2013.01); *A61H 1/0262* (2013.01); *A61H 3/00* (2013.01); *A63B 21/00178* (2013.01); *A63B 21/225* (2013.01); *A63B 21/285* (2013.01); *A63B 22/02* (2013.01); *A63B 22/0605* (2013.01); *A61H 2201/018* (2013.01); *A61H 2201/0192* (2013.01); *A61H 2201/164* (2013.01); *A61H 2201/1652* (2013.01); *A61H 2201/1676* (2013.01); *A61H 2205/10* (2013.01); *A63B 21/4011* (2015.10); *A63B 22/0235* (2013.01); *A63B 2022/0094* (2013.01); *A63B 2071/0072* (2013.01); *A63B 2225/09* (2013.01); *A63B 2225/093* (2013.01)

(58) Field of Classification Search

CPC ..... A63B 21/00181; A63B 21/00178; A63B 21/225; A63B 22/02; A63B 22/0605; A63B 21/285; A63B 2071/0072; A63B 22/0235; A63B 21/4011; A63B 2022/0094; A63B 2225/09; A63B 2225/093; A61H 1/0262; A61H 3/00; A61H 2201/018; A61H 2201/1676; A61H 2201/1652; A61H 2201/0192; A61H 2201/164; A61H 2205/10

See application file for complete search history.

(56) References Cited

U.S. PATENT DOCUMENTS 4,505,681 A * 3/1985 Jones ..... A63C 11/10 273/DIG. 19
5,167,601 A * 12/1992 Frappier ..... A63B 21/0552 482/121

(Continued)

*Primary Examiner* — Garrett K Atkinson
(74) *Attorney, Agent, or Firm* — Goodwin Procter LLP

(57) ABSTRACT

A gait trainer adapted for use with a treadmill and, optionally, a spinning cycle, provides greater accessibility for therapeutic and rehabilitative gait pattern training to individuals confronting injury, illness, or disability. The gait trainer is adjustable, to accommodate a wide variety of users with different stride lengths and needs.

20 Claims, 9 Drawing Sheets

Related U.S. Application Data

(60) Provisional application No. 62/315,955, filed on Mar. 31, 2016.

(51) Int. Cl.
*A63B 71/00* (2006.01)
*A63B 22/00* (2006.01)

(56) References Cited

U.S. PATENT DOCUMENTS 5,803,881 A * 9/1998 Miller ..... A63B 21/0004 482/124
6,123,649 A * 9/2000 Lee ..... A63B 21/153 482/51
6,666,798 B2 * 12/2003 Borsheim ..... A61H 3/00 434/247
6,689,075 B2 * 2/2004 West ..... A61F 5/0102 482/69
6,796,926 B2 * 9/2004 Reinkensmeyer ... A61B 5/1038 482/51
6,821,233 B1 * 11/2004 Colombo ..... A61F 5/0102 482/54
6,837,830 B2 * 1/2005 Eldridge ..... A63B 21/157 482/54
7,331,906 B2 * 2/2008 He ..... A61H 1/0237 482/69
7,998,040 B2 * 8/2011 Kram ..... A63B 21/4013 482/124
8,147,436 B2 * 4/2012 Agrawal ..... A63B 22/0235 602/16
8,308,618 B2 * 11/2012 Bayerlein ..... A63B 21/00181 482/54
9,713,439 B1 * 7/2017 Wu ..... A61B 5/11
9,737,453 B2 * 8/2017 Shimada ..... A61H 1/024
10,039,684 B2 * 8/2018 Meuleman ..... A61H 1/0237
2008/0255488 A1 * 10/2008 Agrawal ..... A63B 69/0064 602/23
2015/0087484 A1 * 3/2015 Bayerlein ..... A63B 21/00181 482/54
2015/0140534 A1 * 5/2015 Brunner ..... A63B 22/0235 434/255

* cited by examiner

GAIT PATTERN TRAINING DEVICE

CROSS-REFERENCE TO RELATED APPLICATIONS

This application is a divisional of U.S. patent application Ser. No. 15/472,767, filed Mar. 29, 2017, which claims priority to and the benefit of U.S. Provisional Patent Application No. 62/315,955, filed on Mar. 31, 2016; the entire disclosure of each of these applications is hereby incorporated by reference.

TECHNICAL FIELD OF THE INVENTION

The invention relates generally to gait training for rehabilitation due to injury, illness, or disability.

BACKGROUND

Repetitive pattern gait training addresses the problem of gaining or re-gaining walking function due to injury, illness, or disability by supporting and positioning the body while guiding the patient through biomechanically sound walking patterns.

The common standard for weight supported gait training requires therapists to employ hands-on manipulation. Typically, a therapist stands or sits next to a patient and is actively involved in pushing, pulling, lifting, and generally guiding the patient's legs through the gait cycle. This approach is imprecise, labor intensive, rigorous for therapist/trainer, and is generally not sustainable for the many hours of repetition typically required to achieve lasting benefits. Capable gait training machines and devices are typically costly and therefore inaccessible to many who would benefit by using them.

SUMMARY OF THE INVENTION

The present invention avoids costly electronics, hydraulics, and other complex systems. It is easy to setup and to use, and is affordable in a wide range of therapy and rehabilitation settings therefore making it more accessible than currently available gait training machines. Due to simplicity and elegance of the design, the present invention may be produced at lower cost, making it affordable to a wider range of facilities and accessible to a wider audience.

The present invention automatically attains patient-specific length of stride, while also maintaining proper hip and knee flexion. The disclosed embodiments of the invention may also be used independently or in a therapist-assisted mode. In the latter mode, the device may be pedal-powered by a therapist, who provides variable and dynamic support (in amounts as needed) as patients work their way through the walking gait pattern. This variable input approach allows therapists/trainers to present patients with just the right amount of challenge, which supports progressive neuromuscular development, muscle and flexibility development, and muscle memory development. Moreover, the present device may also benefit therapists/trainers, as the device is easier to use, is less labor intensive, and because the therapists/trainers may more effectively introduce the right amount of challenge to support progress.

In an aspect, embodiments of the invention relate to a gait trainer adapted for use with a treadmill. The gait trainer may include a pair of linkages, each linkage having a proximal end and a distal end; a pair of boots, each boot coupled to a proximal end of the respective linkage and adapted to receive a foot of a user; a support frame including a pair of pivot members to support the linkages and vertical guides for maintaining motion of the linkages in respective vertical planes; and a crank assembly coupled to the distal ends of the linkages; wherein rotation of the crank assembly translates into motion of the boots in a predetermined gait pattern.

One or more of the following features may be included. The linkages may include tube stock. Each boot may include a cuff and an adjustable strap to accommodate the user's article of footwear. Each boot may connect to the proximal end of the respective linkage above the user's ankle. Each boot may further include a tether point to interconnect the boot to the support frame to control ankle angle to facilitate proper heel strike. Each boot may further include a tether disposed between an external rotation post and a forefoot area of the boot to control foot rotation to facilitate proper forefoot positioning.

Each pivot member may include a wheel mounted below the respective linkage. Each wheel may be adjustable in a vertical direction to adjust hip and knee flexion of the gait pattern. The vertical guides may include vertical rollers. The crank assembly may include a pair of cranks and a distance between the couplings to the distal ends of the linkages defines a user's stride length. The distance may be adjustable to adjust the user's stride length of the gait pattern.

The gait trainer may further include a pair of straps, each strap disposed between a top portion of the respective boot and the support frame to facilitate proper knee extension of the user. The gait trainer may further include a flywheel coupled to the crank assembly to facilitate smooth continuous motion by the user throughout the gait pattern.

In another aspect, embodiments of the invention relate to a method for training gait of a user on a treadmill. The method may include the steps of affixing a pair of boots to the user on the treadmill; starting the treadmill; and constraining a gait pattern of the boots by controlling stride length, hip flexion, and knee flexion using a pair of linkages connected at proximal ends to the boots and at distal ends to a crank assembly.

One or more of the following features may be included. The method may further include the step of facilitating proper heel strike by controlling ankle angle. The method may further include the step of facilitating proper forefoot position by controlling foot rotation. The method may further include the step of adjusting hip and knee flexion of the gait pattern. The method may further include the step of adjusting stride length. The method may further include the step of facilitating proper knee extension of the user. The method may further include the step of facilitating smooth continuous motion by the user throughout the gait pattern.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE FIGURES

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

The gait training device according to various embodiments is adapted to assist a patient in the gaining or re-gaining of walking function, which may have been lost due to illness, injury, or disability. Embodiments of the gait training device are less expensive than currently available gait training devices, making the described gait training device more accessible to patients.

Figure 1A:
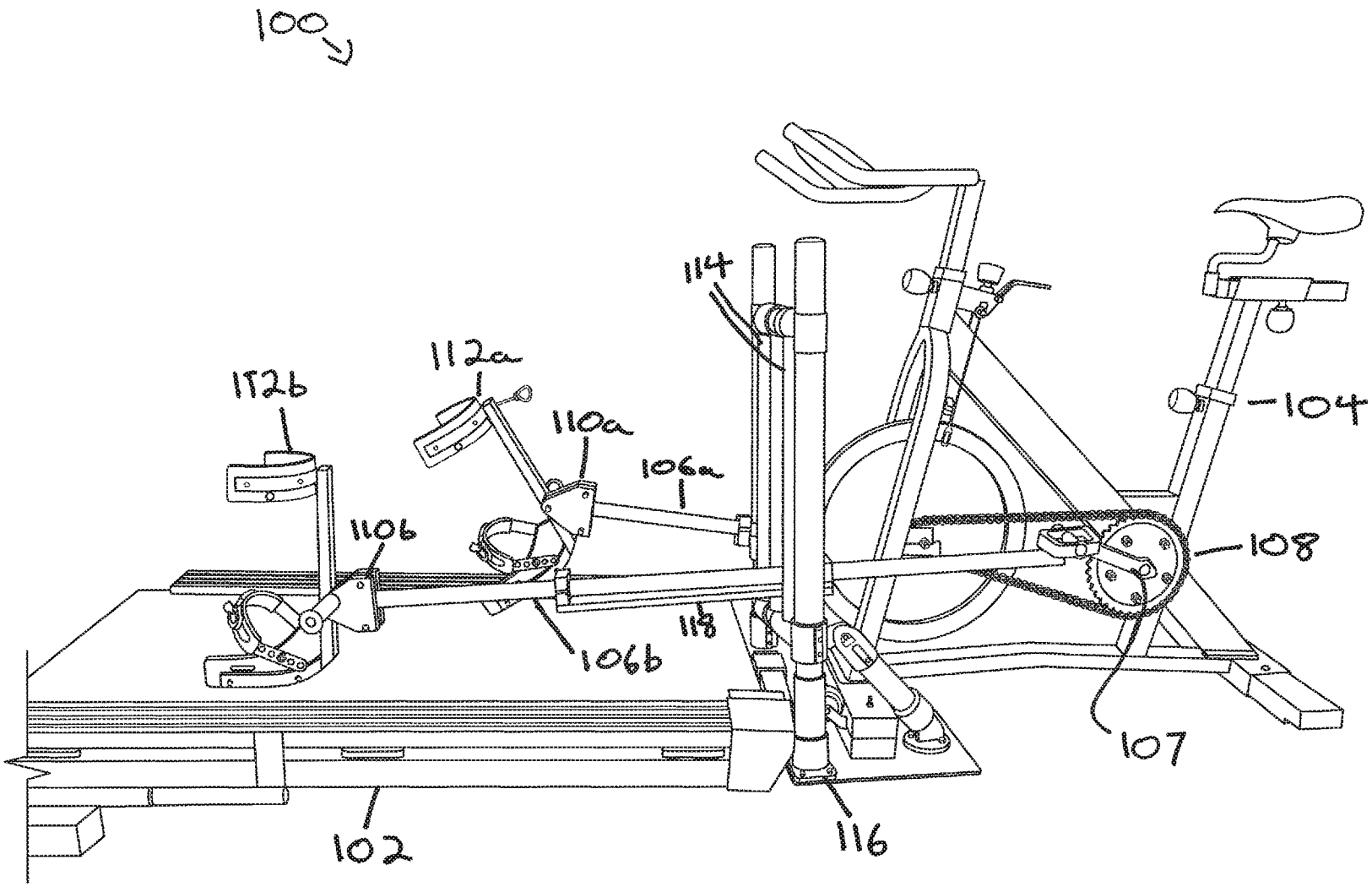
FIGS. 1A and 1B are schematic diagrams of an example of the gait training device in accordance with an embodiment of the invention.

The gait training device 100, shown in FIG. 1, works in conjunction with a conventional treadmill 102. In one embodiment, a spinning cycle 104 is positioned directly behind the treadmill 102. Linkages 106*a*, 106*b* may be affixed at respective distal ends to a crank assembly 108 of the spinning cycle 104 and at respective proximal ends to the device's boot connection 110*a*, 110*b* above the ankle and behind the patient's calf. The boots 112*a*, 112*b*, shown in FIGS. 5A-5D, 6A, and 6B, will be described in further detail below. The linkages 106*a*, 106*b* are confined to move in vertical planes by vertical rollers 114 held in a support frame 116.

The linkages 106*a*, 106*b* may be formed of a stiff material, e.g., aluminum, and may be four to five feet long. In some embodiments the cross section of the linkages is a square. In others it is a circle. In some embodiments, the linkage may be coupled with a flat surface 118 to facilitate smooth movement over respective pivot members 220*a*, 220*b* (shown in FIGS. 2A and 2B) such as wheels or rollers. In some embodiments, the linkages 106*a*, 106*b* may move in a counterclockwise fashion. The length of the spinning cycle crank 107 may be changed to adjust for longer or shorter stride length. For example, a 100 mm crank length may be suitable for most adult users.

Figure 1B:
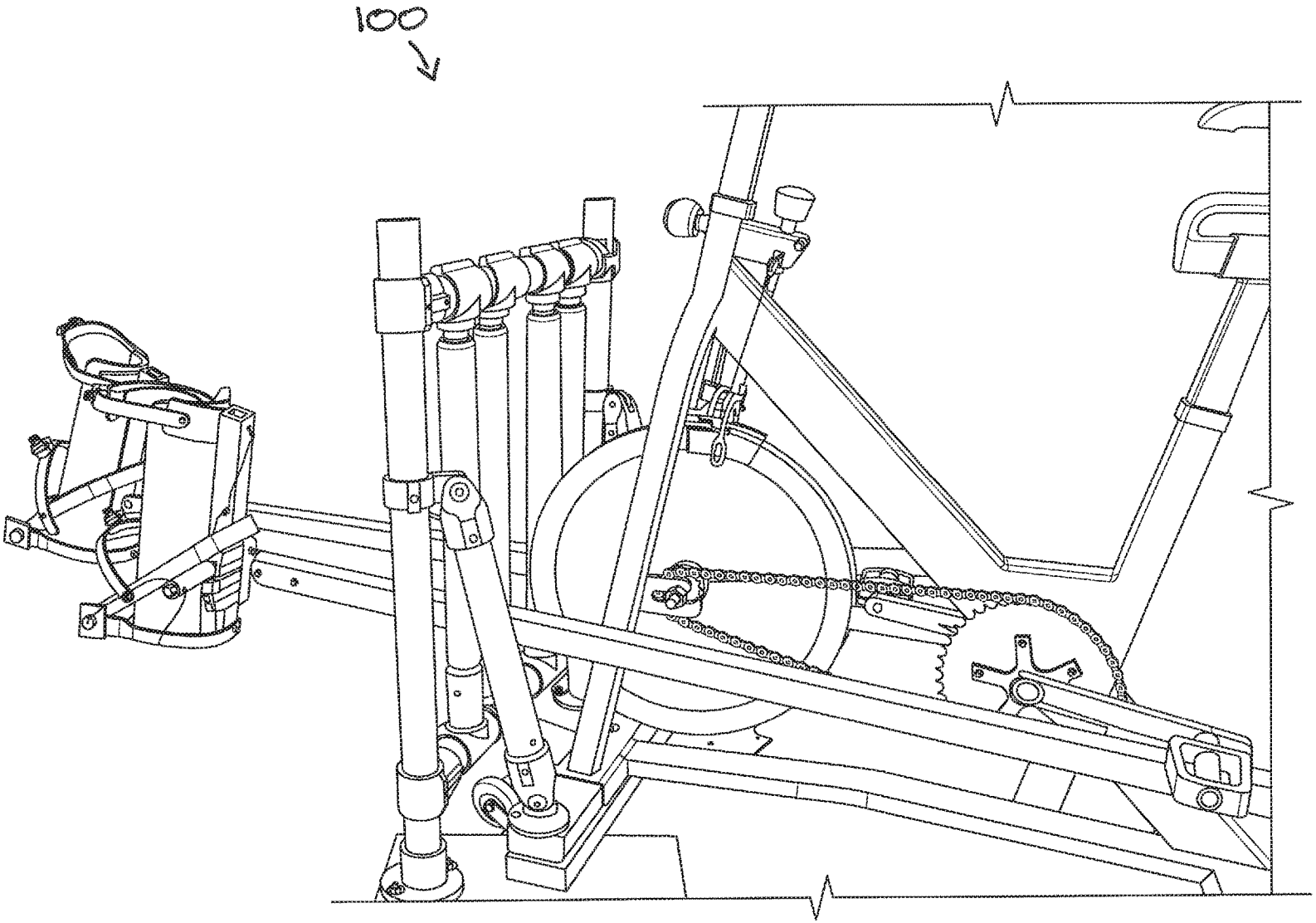

FIG. 1B shows an enlarged perspective view of the gait training device 100 without the treadmill 102.

Figure 2A:
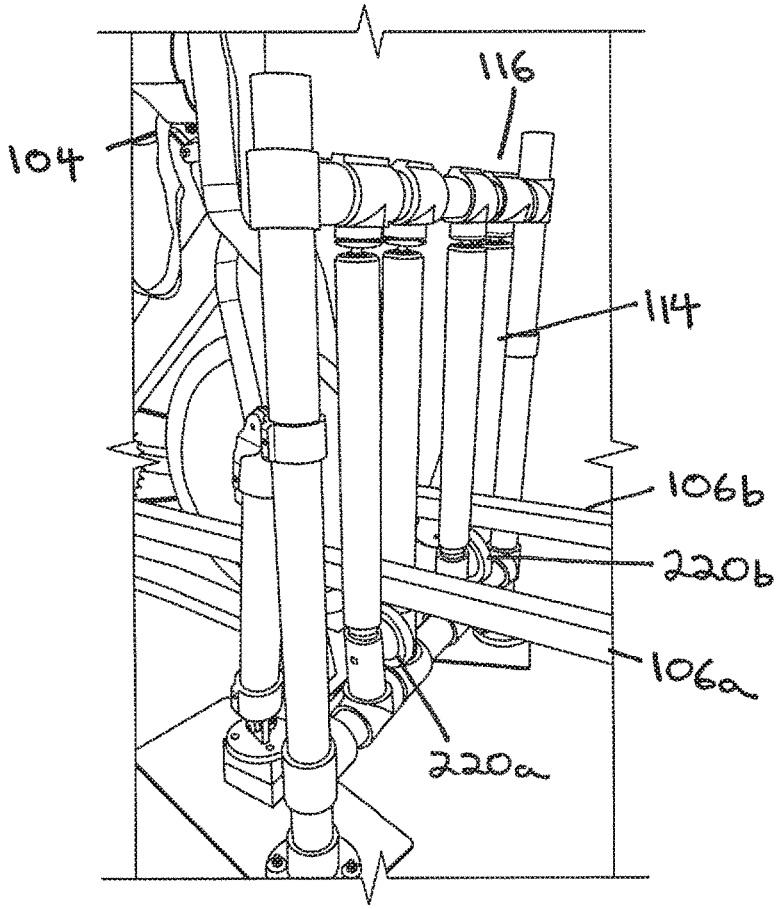
FIGS. 2A and 2B are schematic diagrams of the vertical rollers and pivot members of the gait training device in accordance with embodiment of the invention.
Figure 2B:
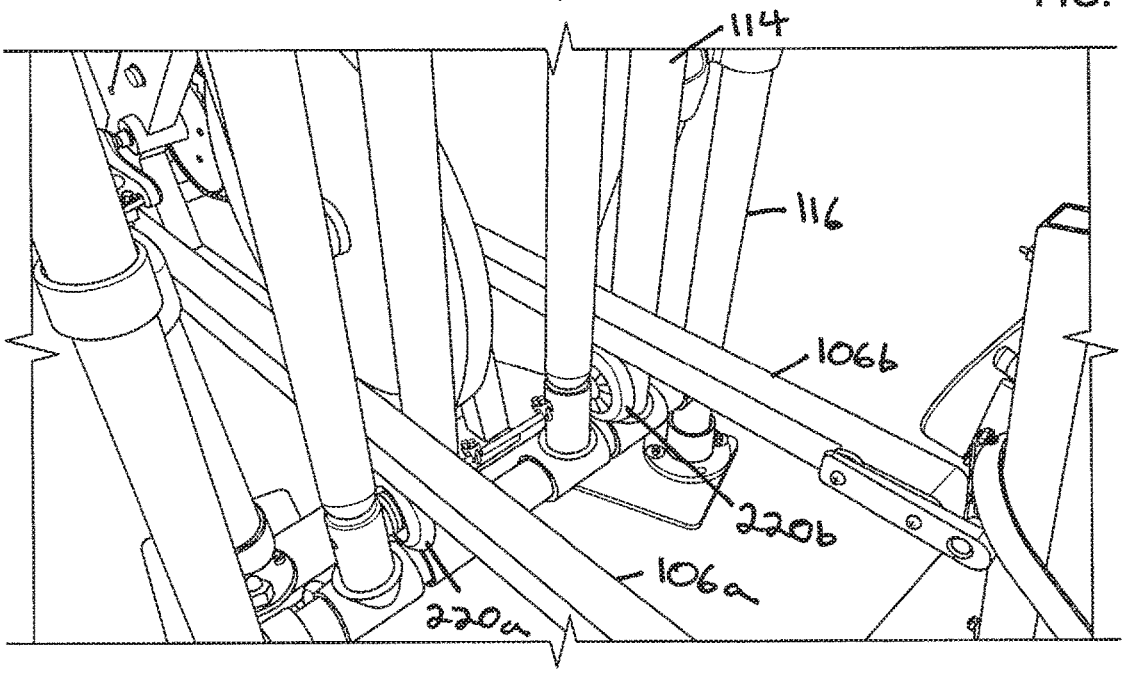

Referring to FIGS. 2A and 2B, the support frame 116 placed between the spinning cycle 104 and the treadmill 102 aligns the linkages 106*a*, 106*b* using vertical rollers 114. These vertical rollers 114 keep the linkages 106*a*, 106*b* parallel to each other, prevent the stance of the user (stride width) from getting too wide, and prevent scissoring, as well as hip abduction/adduction.

The support frame 116 also includes two pivot members 220*a*, 220*b* placed underneath each linkage 106*a*, 106*b* and between the vertical rollers 114. The pivot members 220*a*, 220*b* allow the linkages 106*a*, 106*b* to pivot as the crank assembly 108 is turned, thereby mimicking the path a foot travels during a walking gait at the proximal end of the linkage. These pivot members 220*a*, 220*b* can be raised or lowered to induce more or less hip and knee flexion. In some embodiments, each pivot member 220*a*, 220*b* may be a rubber wheel.

The present invention turns circular, rotary motion into up/down/forward/backward foot, leg, and hip movement with adjustable flexion and extension to accommodate length and height of the individual patient's stride. As the treadmill 102 begins to move the stance phase leg may be driven backward (in conjunction with the direction of movement of the treadmill deck) and the cycle 104 spins in a reverse motion. The other linkage propels the swing leg forward and upward, to achieve a chosen length of stride, hip flexion, and knee flexion consistent with a successful gait cycle.

As the treadmill 102 moves, the stance leg drives the crank assembly 108 arm, which in turn drives the other linkage. The linkages 106*a*, 106*b* come into contact with pivot members 220*a*, 220*b* in the support frame 116 in a levering action, which raises and lowers the height of the linkages 106*a*, 106*b* where they contact the boot 110*a*, 110*b*, thereby lifting and driving the patient's legs.

In some embodiments, the device 100 may be effective using the speed and power of a treadmill 102 without an additional motor. In other embodiments, the device 100 may be pedal-assisted by a therapist or trainer to help the patient though stride hitches, to address strength and flexibility issues, and improve the patient's walking rate.

The present invention may also be used with modified spinning cycles with heavy (40 lbs. or greater) flywheels. In some embodiments, the flywheels create rotational inertia, which helps the patient continue walking at points in their gait where they have the most difficulty. If the patient needs help with timing or getting the unit to work independently, a therapist or trainer may pedal the device to help influence better gait. The present invention may be used in conjunction with a weight support harness to support the patient on the treadmill 102.

Figure 3:
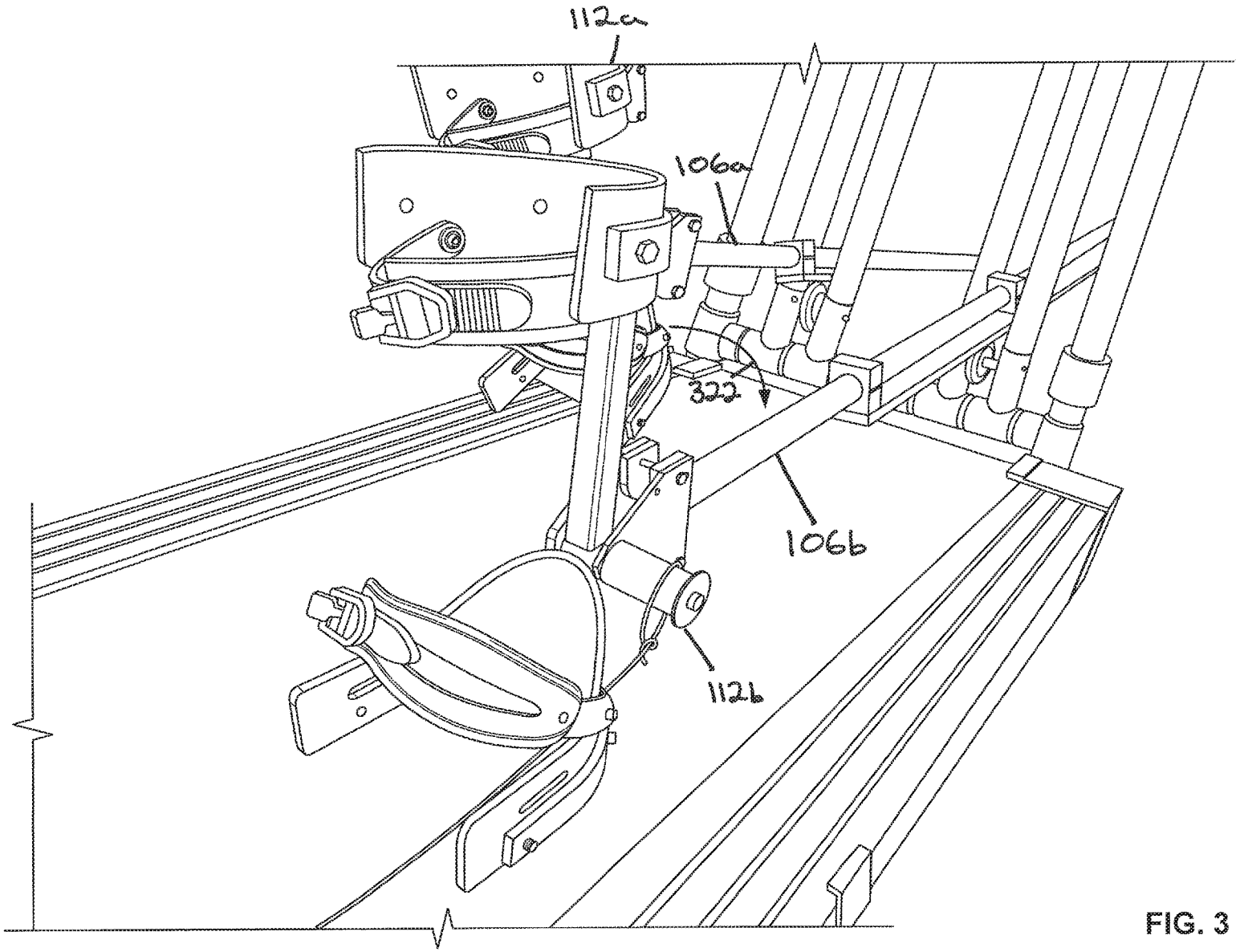
FIG. 3 is a perspective view of the gait training device in accordance with an embodiment of the invention.

Another view of the gait training device 100 is shown in FIG. 3. Here, the linkages 106*a*, 106*b* are in a mid-stride position. In some embodiments, the pivot members 220*a*, 220*b* act as fulcrums for the linkages 106*a*, 106*b*. As indicated by the arrow 322, each boot 112*a*, 112*b* may rotate about an axis parallel to the respective linkage 106*a*, 106*b*, which facilitates a greater range of motion in the user. At the farthest forward extent of motion, the linkage 106*a*, 106*b* no longer rests on the pivot member 220*a*, 220*b*, and remains above and out of contact with the pivot member 220*a*, 220*b* throughout the stance phase of the gait while the patient's feet are on the treadmill 102.

Figure 4:
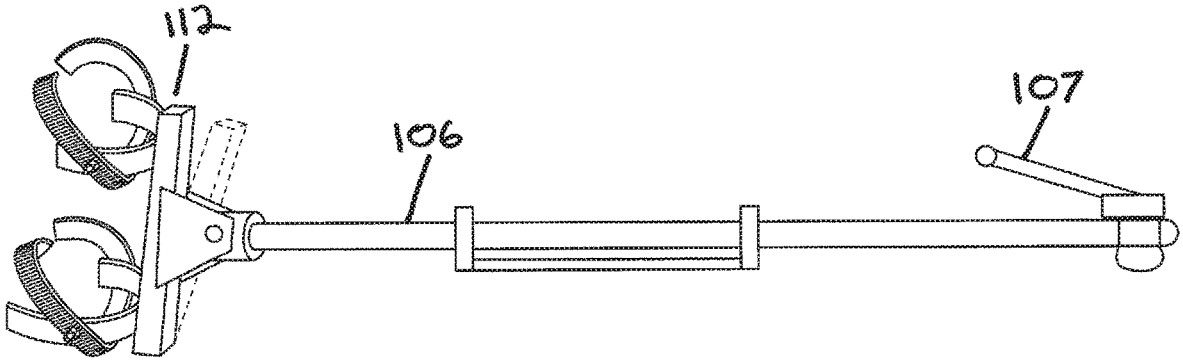
FIG. 4 is a schematic diagram of the boot-linkage assembly of the gait training device in accordance with embodiment of the invention.

Referring to FIG. 4, the boot 112 may also pivot about an axis perpendicular to the linkage and parallel to the ground. This pivot allows the boot 112 to be adjustable with respect to lower leg angle to address issues of valgus or varus stress at the knee.

As depicted in FIGS. 5A-5D, the patient may be connected to the linkages 106*a*, 106*b* via adjustable boots 112*a*, 112*b* designed to fit over shoes inclusive of patient-specific braces or other ankle foot orthosis (AFO) devices. The lower leg may be captured by the boot 112 and fastened to the leg using ratcheting binding straps 524 and/or hook and loop fasteners 526 connected to aluminum cuffs 528. In some embodiments, the boot 112 may be a shell that fits over patient orthoses, bracing, and/or shoes (shown in FIGS. 6A and 6B) and may contribute to proper ankle rotation and controlled heel strike.

In some embodiments, an external rotation post 530 extends laterally from the back of the boot and connects to a hook and loop muzzle 526 on the forefoot. The hook and loop muzzle 526 secures the forefoot area. In some embodiments, a lateral tether 532 provides tension from the muzzle 526 laterally to the external rotation post 530 to insure proper foot positioning. This aid pulls the foot into proper external rotation to prevent excessive internal rotation and may be helpful in introducing additional dorsi-flexion.

Figure 5A:
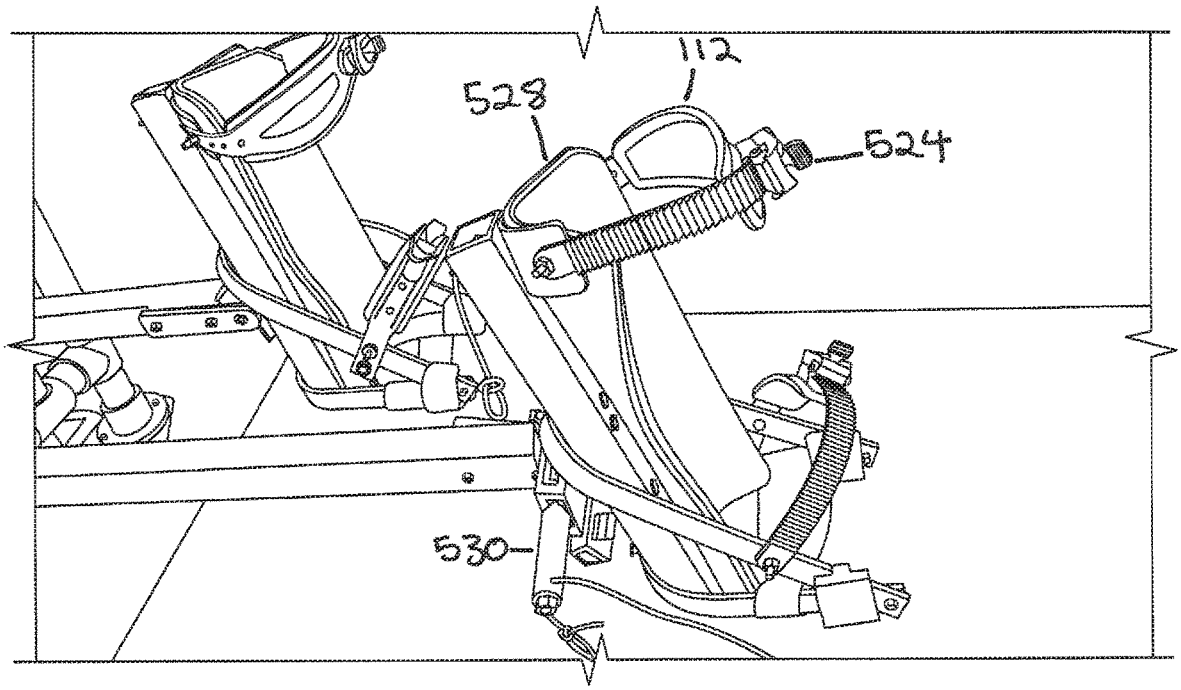
FIGS. 5A-5D are schematic diagrams of the boot of the gait training device in accordance with an embodiment of the invention.
Figure 5B:
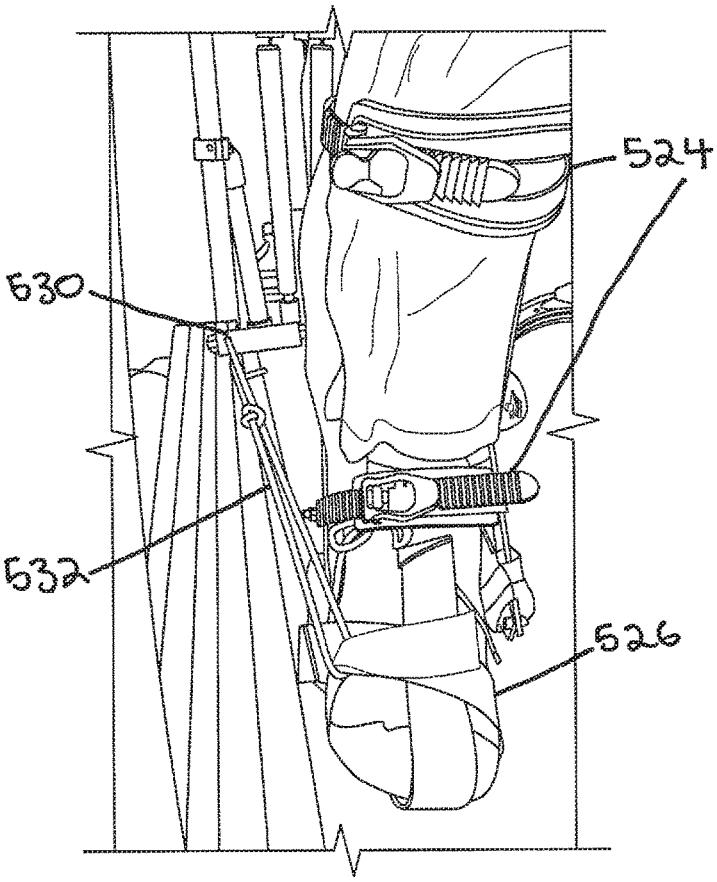
Figure 5C:
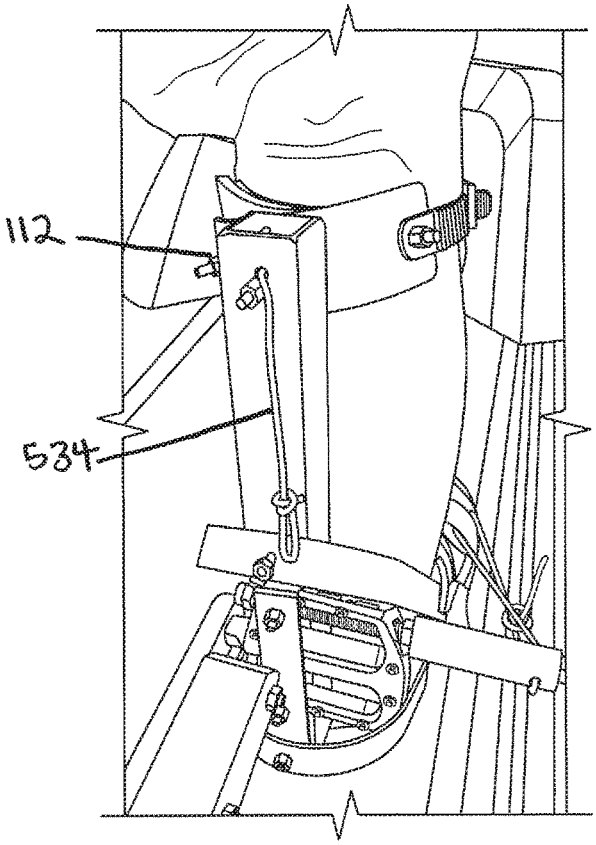
Figure 5D:
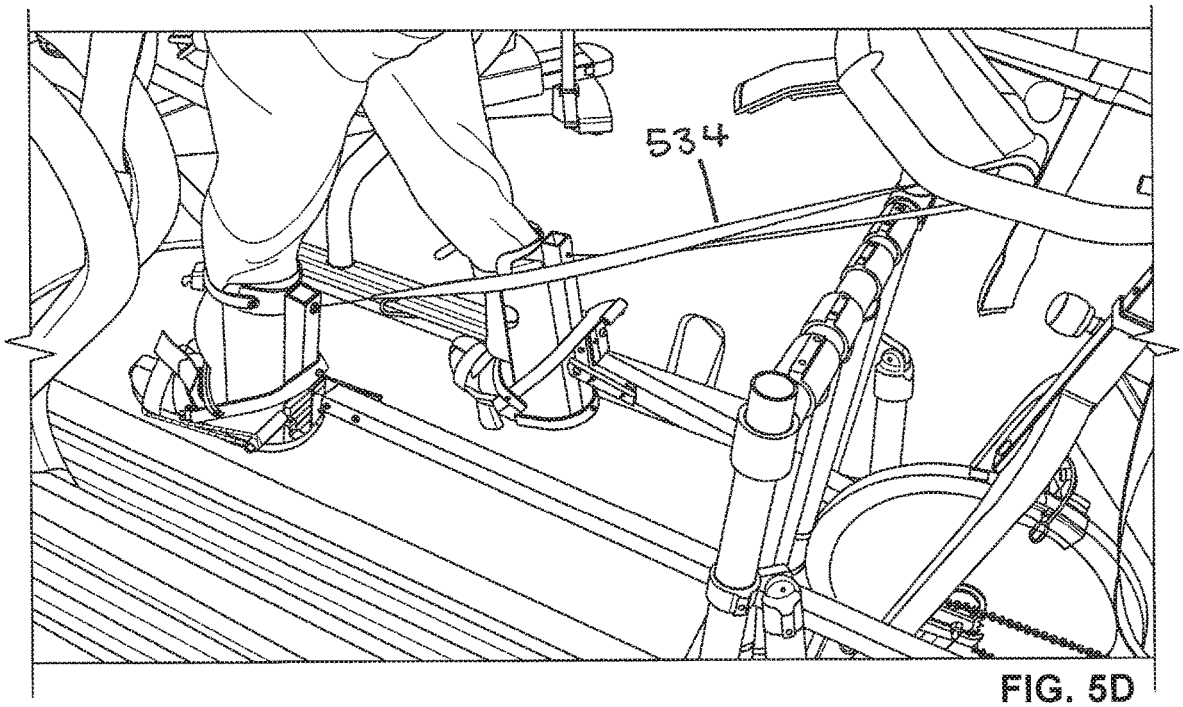
Figure 6B:
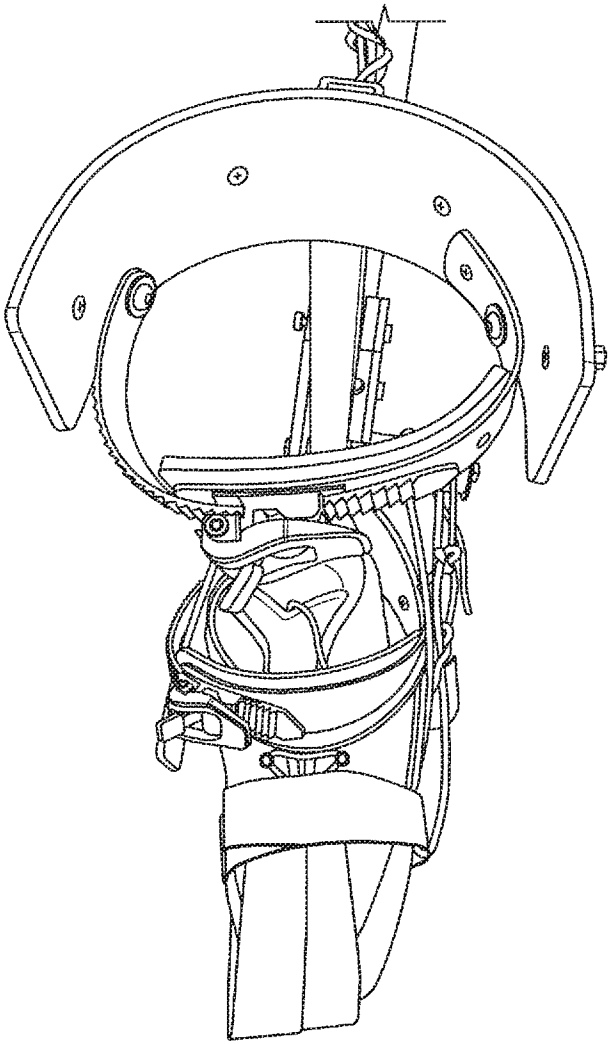
FIGS. 6A and 6B are schematic diagrams of the boot of the gait training device in accordance with an embodiment of the invention.
Figure 6A:
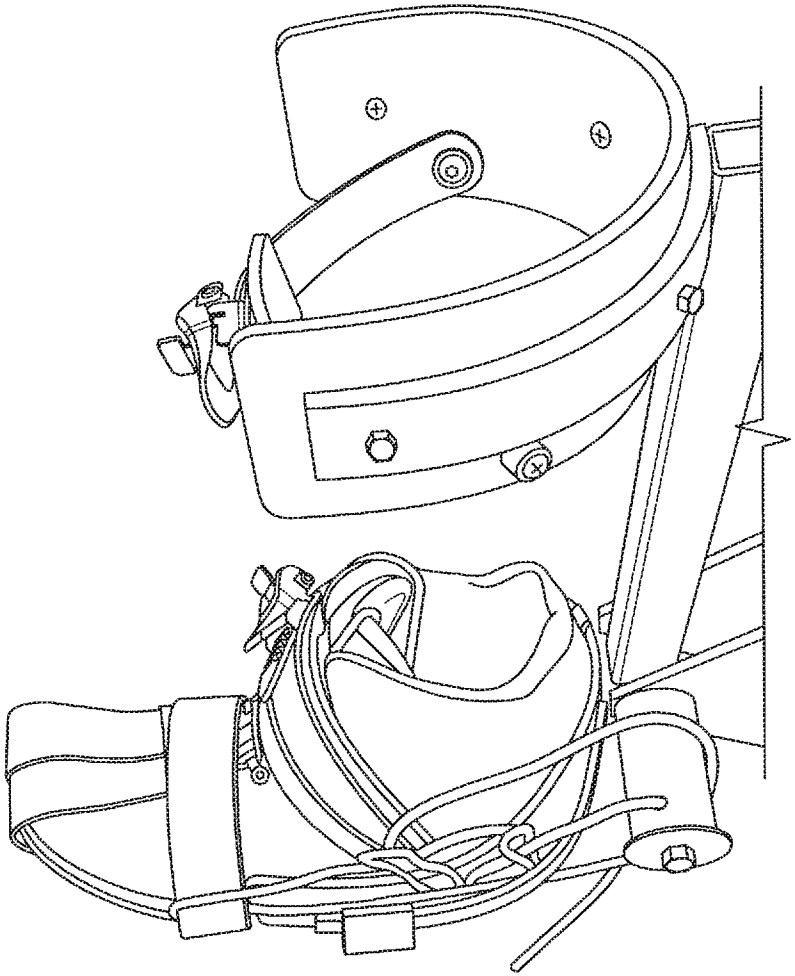

The top of the boot may be tethered to a point on the device in order to force a firm heel strike, shown in FIGS. 5C and 5D. A cord and/or tether 534 may be attached to the back of the boot 112. The tether 534 may be a strap or elastic cord. The boot connection may be designed to influence both the ankle and the calf. Based on patient needs, the top rear of the boot may be connected to high point on the device by the tether 534 in some embodiments. When tightened, this tether pulls back just below the knee to induce appropriate knee extension at terminal swing or initial contact.

Figure 7:
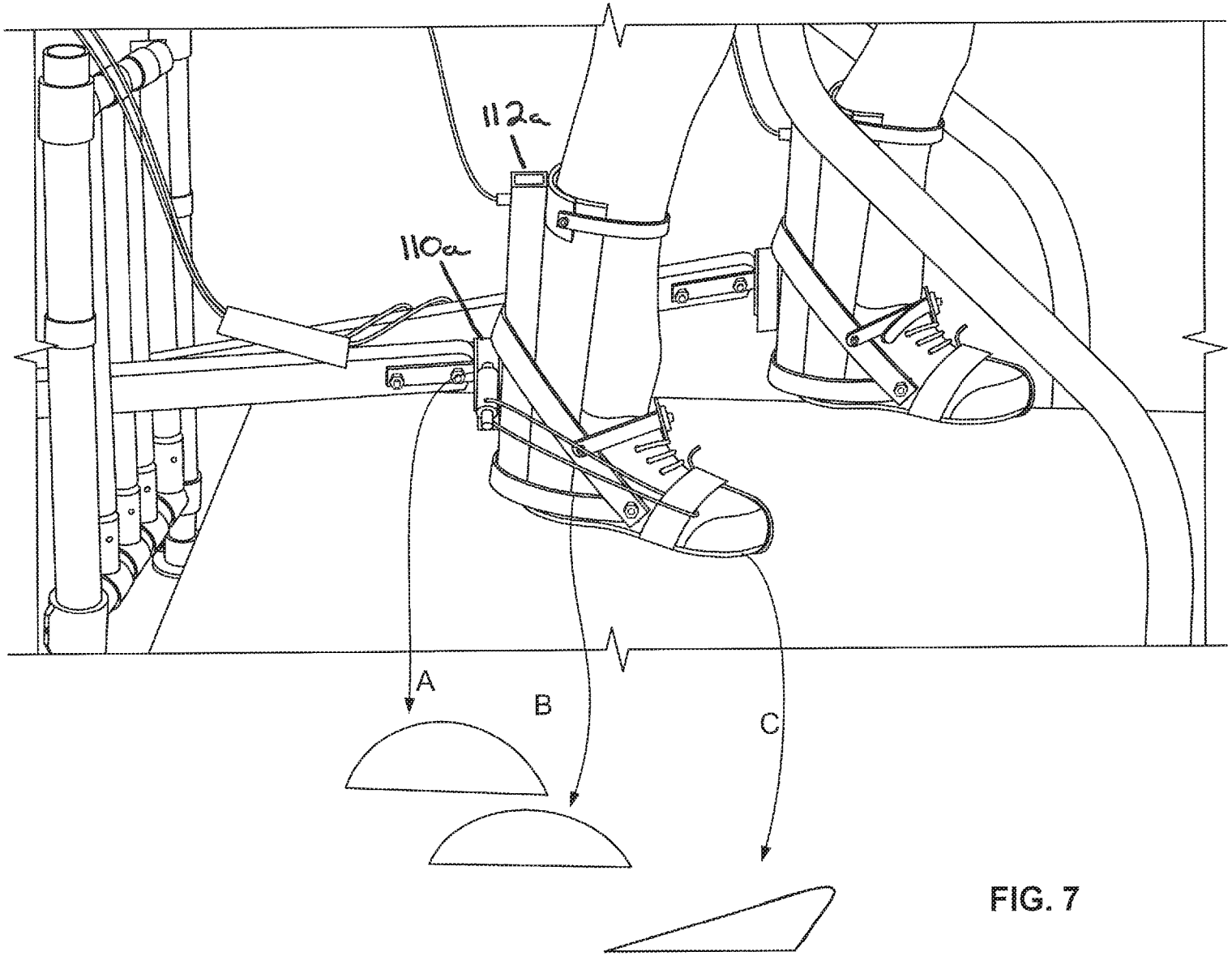
FIG. 7 is a diagram showing the path traveled by the foot during a user's stride.

Referring to FIG. 7, traces A, B, and C show the path that the boot 112 travels at the connection point 110 (Trace A), the midfoot region (Trace B), and the toe. The connection point 110 and midfoot region of the user travel similar paths. Trace C demonstrates that the device 100 facilitates a proper gait, with the toe pointing upward at the heel-strike phase of the stride.

As previously described, the gait trainer transforms circular, rotary motion of the crank assembly into a repeatable up/down/forward/backward gait pattern. As shown, the crank assembly traces a circle in a counterclockwise direction while in use. As the crank assembly turns, the proximal end of the linkage attached to the boot begins to trace a circle, which is then cut off at a flat line as the boot comes in contact with the treadmill. This motion, however, may not be fully constrained as the linkages are free to lift off the pivot members.

More particularly, FIG. 7 depicts an example of three trace patterns, taken at three points along the boot portion, for a particular user during a gait training session. Pattern A is a trace of the connection point at the proximal end of the linkage to the boot. Pattern B is a trace of a point generally located at the midfoot portion of the user. Pattern C is a trace of a point generally located at the toe portion of the user. As can be expected, there is close correlation between patterns A and B, with some variability (i.e., lessening of the height of the upper arcuate portion of pattern B) due to pivoting at the connection point to accommodate the user's personal gait. This effect is more apparent at the toe, depicted in pattern C, due to the combined effect of the pivoting of the connection and changes in the user's ankle angle, at toe off and elsewhere in the swing phase through heel strike.

These pattern variations are user-dependent and provide each user some freedom of movement (within limits) within the broader constraints of the gait trainer gait pattern and associated training methodology. The influence of the gait trainer at connection point A is greater than at other points, allowing sufficient freedom of movement at points remote therefrom (e.g., at the midfoot point B and the toe point C) to engage one's personal gait and accommodate users of different capabilities, for example, individuals who tend to point or drag toes. Nonetheless, the gait trainer provides the necessary safety net for safe, reliable gait pattern training.

Table 1 is a table of minimum, maximum, and typical values for parameters associated with various embodiments of the invention. These values are meant to be exemplary in nature for teenagers and adults of normal stature and body proportions; however, lower and higher values are considered to be within the teachings and scope of the invention to manufacture systems for others, such as children.

TABLE 1

| Feature | Min Val. | Nominal Val. | Max Val. | Unit |
|---|---|---|---|---|
| Diameter of crank assembly | 100 | 200 | 300 | cm |
| Length of linkage | 48 | 54 | 66 | in |
| Height adjustment of pivot wheels | −2 | 0 | +2 | in |
| Distance between crank axis of rotation and pivot wheels | 22 | 28 | 34 | in |
| Ratio of diameter of crank assembly to diameter of stride length | 2:3 | 1:1 | 3:2 | |
| Stride length | 100 | 200 | 300 | cm |

The terms and expressions employed herein are used as terms and expressions of description and not of limitation and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. The structural features and functions of the various embodiments may be arranged in various combinations and permutations, and all are considered to be within the scope of the disclosed invention. Unless otherwise necessitated, recited steps in the various methods may be performed in any order and certain steps may be performed substantially simultaneously. Accordingly, the described embodiments are to be considered in all respects as only illustrative and not restrictive. Furthermore, the configurations described herein are intended as illustrative and in no way limiting. Similarly, although physical explanations have been provided for explanatory purposes, there is no intent to be bound by any particular theory or mechanism, or to limit the claims in accordance therewith.

What is claimed is:

1. A method of training gait of a user on a treadmill, the method comprising the steps of:

affixing a pair of boots to the user on the treadmill;

starting the treadmill; and constraining a gait pattern of the boots by controlling stride length, hip flexion, and knee flexion using a pair of linkages connected at proximal ends to the boots and at distal ends to a crank assembly.

2. The method of claim 1, further comprising the step of facilitating proper heel strike by controlling ankle angle.

3. The method of claim 1, further comprising the step of facilitating proper forefoot position by controlling foot rotation.

4. The method of claim 1, further comprising the step of adjusting hip and knee flexion of the gait pattern.

5. The method of claim 4, wherein adjusting hip and knee flexion comprises setting a minimum height of the linkages using respective pivot members.

6. The method of claim 1, further comprising the step of adjusting stride length.

7. The method of claim 1, further comprising the step of facilitating proper knee extension of the user.

8. The method of claim 1, further comprising the step of facilitating smooth continuous motion by the user throughout the gait pattern.

9. The method of claim 8, wherein facilitating smooth continuous motion comprises use of a flywheel.

10. The method of claim 1, wherein, during at least a portion of the constraining of the gait pattern, each boot contacts a moving treadmill belt of the treadmill.

11. The method of claim 1, wherein the connection of each boot to a respective linkage allows each boot to rotate about an axis parallel to the respective linkage.

12. The method of claim 1, wherein the connection of each boot to a respective linkage allows each boot to pivot about an axis perpendicular to the respective linkage and parallel to ground.

13. The method of claim 12, wherein the fixed support fame comprises a pair of pivot members to support the linkages, each pivot member providing a minimum height for the respective supported linkage.

14. The method of claim 12, wherein the fixed support frame comprises vertical guides, and constraining the gait pattern further comprises maintaining motion of the linkages in respective vertical planes by the vertical guides.

15. The method of claim 1, wherein a fixed support frame is disposed between the pair of boots and the crank assembly.

16. The method of claim 15, further comprising interconnecting each boot to the fixed support frame with a respective tether to control ankle angle to facilitate proper heel strike.

17. The method of claim 1, wherein constraining the gait pattern further comprises rotating the crank assembly, with rotation of the crank assembly translating into motion of the boots in a predetermined gait pattern.

18. The method of claim 1, wherein each boot comprises a cuff and an adjustable strap to accommodate the user's article of footwear.

19. The method of claim 18, wherein affixing the pair of boots to the user on the treadmill comprises fastening each adjustable strap around a leg of the user.

20. The method of claim 1, further comprising defining a user's stride length by a longitudinal distance between couplings of the crank assembly at the distal ends of the linkages.

* * * * *